US008162459B2

(12) United States Patent
Kanesaka

(10) Patent No.: US 8,162,459 B2
(45) Date of Patent: Apr. 24, 2012

(54) INK CARTRIDGE AND RESIDUAL AMOUNT DISPLAY METHOD

(75) Inventor: Toshiya Kanesaka, Chiba (JP)

(73) Assignee: Seiko I Infotech Inc. (JP)

( * ) Notice: Subject to any disclaimer, the term of this patent is extended or adjusted under 35 U.S.C. 154(b) by 323 days.

(21) Appl. No.: 12/592,431

(22) Filed: Nov. 24, 2009

(65) Prior Publication Data

US 2010/0141716 A1 Jun. 10, 2010

(30) Foreign Application Priority Data

Nov. 26, 2008 (JP) ..... 2008-300722
Sep. 25, 2009 (JP) ..... 2009-221245

(51) Int. Cl.
*B41J 2/175* (2006.01)

(52) U.S. Cl. ..... 347/86

(58) Field of Classification Search ..... 347/7, 85, 347/86, 108
See application file for complete search history.

(56) References Cited

U.S. PATENT DOCUMENTS 5,666,146 A * 9/1997 Mochizuki et al. ..... 347/86
6,053,606 A * 4/2000 Yamaguchi et al. ..... 347/86
6,375,316 B1 * 4/2002 Okubo et al. ..... 347/86
7,195,330 B2 * 3/2007 Seino et al. ..... 347/19

* cited by examiner

*Primary Examiner* — Anh T. N. Vo
(74) *Attorney, Agent, or Firm* — Adams & Wilks

(57) ABSTRACT

An ink cartridge has an ink bag which changes in thickness in accordance with a change in an amount of ink. The bag is accommodated in a housing having a guide groove and a window portion. A plate is mounted on the bag for movement therewith and has a pin undergoing movement in the guide groove during movement of the plate. A reflecting plate with a first reflectivity is displayed by the window when bag contains ink. A slide member has a reflecting portion with a second reflectivity different from the first reflectivity and engages the plate pin for sliding movement relative to the housing during movement of plate pin. In a first position relative to the housing, the slide member does not cover the window portion and the reflecting plate is displayed from the window portion which corresponds to a state in which the bag contains ink. In a second position relative to the housing, the slide member covers the window portion and the reflecting portion of the slide member is displayed from the window portion which corresponds to a state in which the bag does not contain ink.

18 Claims, 10 Drawing Sheets

INK CARTRIDGE AND RESIDUAL AMOUNT DISPLAY METHOD

BACKGROUND OF THE INVENTION

1. Field of the Invention

The present invention relates to an ink cartridge for use in an inkjet recording apparatus for recording images, characters, and the like on recording paper by ejecting ink droplets from a nozzle, and to a residual amount display method of ink of the ink cartridge.

2. Description of the Related Art

Currently, there are provided in various kinds ink jet printers for recording images, characters and the like by ejecting ink droplets on a recording medium, such as recording paper. In the ink jet printer, ink is supplied from an ink cartridge to a recording head through an ink supply tube, and the ink droplets are ejected from a nozzle of the recording head onto the recording paper, thereby performing recording.

Further, generally, in an ink cartridge used for an ink jet printer, an ink bag in which ink is sealed in advance is accommodated in a casing. The ink bag is configured to have flexibility and deform according to the ink residual amount so that the thickness thereof changes. Then, the ink residual amount is estimated by measuring the thickness of the ink bag. This is because the ink residual amount cannot be directly measured.

For example, Japanese Patent Application Laid-Open No. 2007-268721 describes an ink cartridge capable of detecting the residual amount. In the ink cartridge, a housing of the ink cartridge is stuck to one surface of the ink bag, and a plate is stuck to the other surface so that the plate can move according to the ink residual amount. Thus, by detecting a state where the plate arrives at a position corresponding to the ink residual amount of "zero", it is possible to detect a state where the ink is used up.

The plate includes a pin protruding toward the side surface of the housing, which pin is inserted into a rotatable lever portion that can slidably move on the side surface of the housing. The lever portion is provided with a nonreflective plate. The housing has an opening, where a reflecting plate is arranged at a back of the opening. The plate moves according to a volume of the ink, and the lever portion rotates by the pin.

In a case where the ink has not been consumed, the lever portion is not positioned between the reflecting plate and a window, and the light entering the window is reflected by the reflecting plate. In a case where the ink has been consumed, the lever portion is positioned between the reflecting plate and the window, and the light entering the window is not reflected by the nonreflective plate. Thus an ink cartridge is provided in which the ink residual amount can be recognized by detecting the state of the reflected light.

However, the conventional ink cartridge still has the following problems to be solved.

In the conventional ink cartridge, the pin formed in the plate moves by expansion and contraction of the ink bag. Additionally, a proximal end of the lever portion is engaged with the housing, and the lever portion rotates so that a distal end thereof draws a circular arc. A guide groove having a long hole-shape along a length direction of the lever portion is provided at the distal end of the lever portion, and the pin is inserted into such guide groove. A guide member is provided at the side surface of the housing so that the distal end of the lever portion slidably moves on the side surface of the housing. According to such structure, the movement of the pin is regulated to the track of the guide groove of the lever portion.

The pin moves three-dimensionally in accordance with the movement of the ink bag because the pin is formed at the plate fixed to the ink bag. The ink bag does not perform a regular movement every time, and performs different movements every time depending on the installed situation, usage frequency, and the like. Thus, the lever portion regulating the movement of the pin is applied with force according to the movement of the pin. Problems do not arise if the pin performs a linear movement in a thickness direction of the ink bag according to expansion and the contraction of the ink bag, but in other cases, the ink residual amount may not be correctly indicated if the pin applies force in various directions to the lever portion. Further, another problem arises in that the lever portion may become hard to move due to friction with the side surface, and hence the ink residual amount may not be correctly displayed.

SUMMARY OF THE INVENTION

The present invention has been made in view of such circumstances, and it is an object of the present invention to provide an ink cartridge in which an ink residual amount detector performs a regular movement every time so that error detection of an ink residual amount may be prevented, and in which friction between parts is alleviated so that error detection of an ink residual amount may be further prevented. The present invention also provides a residual amount display method.

The foregoing and other objects are achieved by the present invention as follows.

According to the present invention, there is provided an ink cartridge including: a flexible ink bag having ink sealed in an inside thereof, a thickness of the flexible ink bag changing according to an amount of the ink; a housing for accommodating the ink bag by fixing to a bottom surface of the housing; and a plate fixed to a side opposing the bottom surface of the ink bag, the plate including a pin protruding toward a side surface of the housing;

the ink cartridge further including: a window provided at the side surface; a reflecting plate having a first reflectivity displayed from the window, a slide plate having a guide hole of long hole shape, to which the pin is inserted, arranged slanted with respect to a sliding direction and a reflecting plate having a second reflectivity; and a linear guide groove provided at the side surface to fit with the pin and regulate a movement of the pin, wherein, when the plate moves according to the ink amount, the pin linearly moves along the guide groove in association with the movement, the slide plate slidably moves on the side surface as an abutting position of the pin and the guide hole moves, and the display of the window displays, according to the slidable movement of the slide plate, the reflecting plate having the first reflectivity if the ink is left and displays the reflecting plate of the second reflectivity if the ink is consumed.

In the ink cartridge according to the present invention, the ink bag having the plate fixed to the surface is first accommodated in the housing. In this case, the ink bag is accommodated with the back surface side facing the bottom surface side of the housing. Further, the distal end of the pin of the plate is inserted into the guide hole of the slide plate rotatably provided at the side surface of the housing. That is, the plate and the slide plate are mechanically assembled by fitting of the pin and the guide hole. Further, the pin passing through the slide plate is fitted to the guide groove at the side surface of the housing, and hence the pin linearly moves along with the movement regulated by the guide groove. As the pin linearly moves, the direction of the force at a time when the guide hole of the slide plate and the pin are brought into contact is made constant, whereby the slide plate can be smoothly moved.

In an unused state in which the ink is fully filled in the ink bag, the ink bag is most expanded and the plate is most distant from the bottom surface of the housing. Further, the slide plate is at a first position, and is stably supported by the pin through an intermediation of the guide hole. In this case, further, the reflecting plate having the first reflectivity is positioned at the portion where the detection light entered from the exterior of the housing through the window hits. The detection light hits the reflecting plate and is then reflected. The ink is judged to be still in the ink bag by detecting the reflected light.

When the ink starts to be consumed from the above-mentioned state, the ink bag gradually deforms and the thickness starts to change according to the ink amount left inside. The plate fixed to the surface of the ink bag and the pin also start to gradually move toward the bottom surface of the housing. The slide plate then starts to move following the pin inserted in the guiding groove. In this case, further, the slide plate is in a slide moved state while slidably moving on the side surface of the housing. The slide plate moves while smoothly following the movement of the pin.

When the ink is further consumed and the ink is no longer in the ink bag, the ink bag is in the most deflated state, and thus the plate and the pin are in a state closest to the bottom surface of the housing. The movement of the plate stops, and the slide plate similarly stops at the second position. In this case, the reflecting plate having the second reflectivity different from the first reflectivity is positioned at the portion where the detection light entered from the exterior of the housing through the window hits. As the slide plate moves, the reflectivity of the reflecting plate positioned at the portion where the detection light entered from the exterior of the housing through the window hits changes.

The detection light hits the reflecting plate and is then reflected. Detection is made that the ink is not in the ink bag by detecting the reflected light. The first reflectivity and the second reflectivity differ, and hence the light quantity of the reflected light also differs. In addition, the ink residual amount can be recognized by looking at the reflecting plate through the window.

In particular, the displacement of the ink bag can be changed to the operation of the slide plate that slidably moves on the side surface of the housing through an intermediation of the plate and the pin, that is, the displacement in the thickness direction of the ink bag can be changed to the linear movement of different angles. Further, the movement of the pin is regulated to a linear form by the guide groove, so that the slide plate always slide moves while slidably moving on the side surface even if the ink bag performs an irregular movement three-dimensionally. Thus, the slide plate can always be regularly moved every time. The reflecting plate each having a different reflectivity is displayed through the window in association with the movement of the slide plate. Therefore, the error detection of the ink residual amount can be prevented.

As described above, according to the ink cartridge of the present invention, a regular movement is performed every time so that error detection of the ink residual amount can be prevented.

The ink cartridge of the present invention has the reflecting plate having the first reflectivity arranged spaced apart from the side surface of the housing at a position opposing the window in the ink cartridge of the present invention. The reflecting plate having the second reflectivity is arranged on the slide plate. The reflecting plate having the first reflectivity is displayed from the window when the ink is left, and the slide plate slide moves to between the window and the reflecting plate having the first reflectivity so that the reflecting plate having the second reflectivity arranged on the slide plate is displayed from the window when the ink is consumed.

Further, in the ink cartridge of the present invention, the reflecting plate having the first reflectivity and the reflecting plate having the second reflectivity may be arranged on the slide plate, so that the reflecting plate having the first reflectivity is displayed from the window when the ink is left, the slide plate moves in association with the consumption of the ink, and the reflecting plate having the second reflectivity is displayed from the window when the ink is consumed. The reflecting plate thus does not need to be provided in the housing, and the structure can be simplified. Thinning can also be achieved as the reflecting plate does not need to be overlapped.

In addition, according to the ink cartridge of the present invention, a projection may be provided on the bottom surface of the housing and a surface opposing the bottom surface so that the slide plate is regulated so as not to separate from the side surface of the housing. The slide plate undergoes sliding movement on the side surface of the housing in a stable state. The error detection of the ink residual amount can thus be more reliably prevented.

In addition, the consuming rate of the ink and the movement rate of the slide plate can be differed by forming the guide hole of the slide plate of the ink cartridge of the present invention into a curved shape. The fine or rough display can thus be made according to the residual amount, and the state of the residual amount can be correctly displayed at the desired residual amount.

The residual amount display method of the present invention has a characteristic in displaying the reflecting plates each having a different reflectivity from the window according to the ink residual amount using the above-mentioned ink cartridge.

According to the ink cartridge and the residual amount display method of the present invention, a regular and smooth movement is performed every time so that error detection of the ink residual amount can be prevented.

DETAILED DESCRIPTION OF THE PREFERRED EMBODIMENTS

One embodiment of a recording apparatus and an ink cartridge according to the present invention are hereinafter described with reference to FIG. 1 to FIG. 7.

Figure 1:
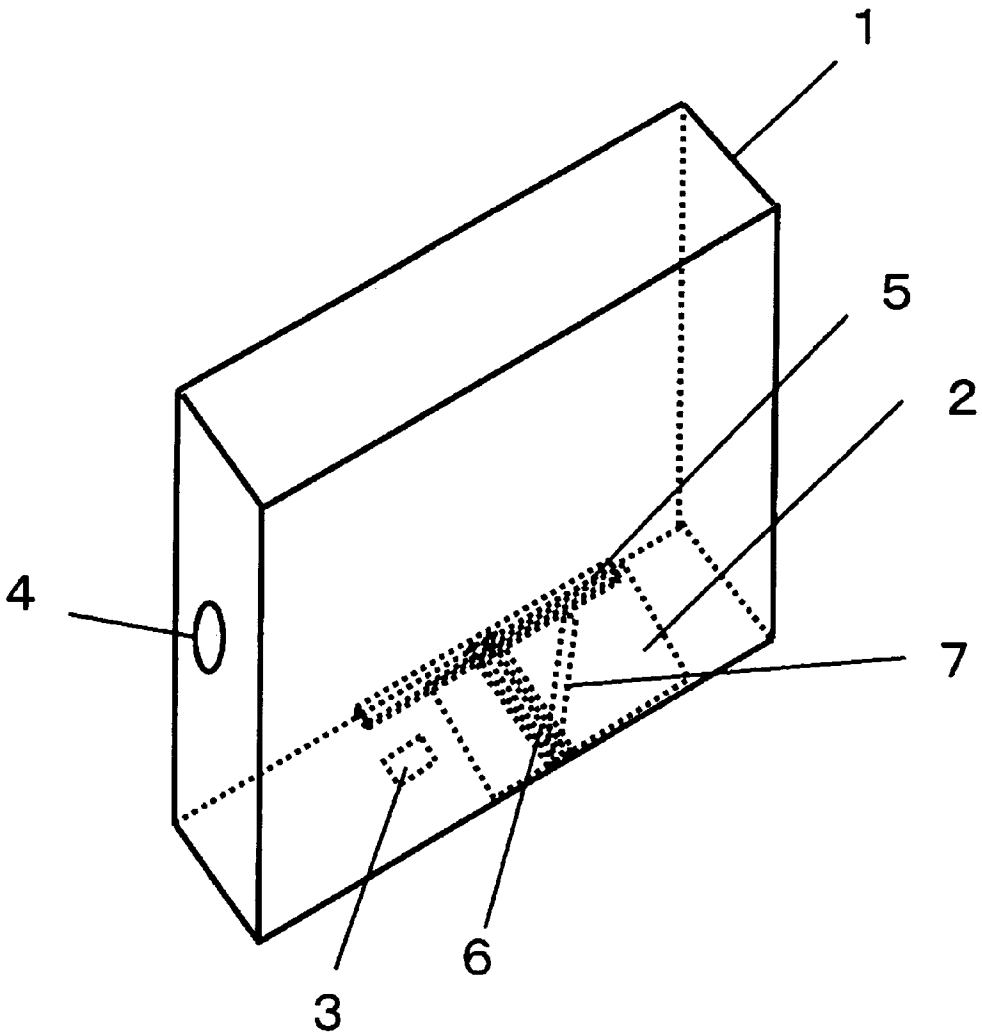
FIG. 1 is a schematic perspective view of an ink cartridge.

FIG. 1 is a schematic perspective view of an ink cartridge. The schematic structure of the ink cartridge will be described. A housing 1 is a box-shaped container made of plastic. A window 3 is a through-hole formed at the side surface of the housing 1. An ink take-out port 4 is a through-hole formed in the housing 1 for fixing a spout of an ink bag, to be hereinafter described. A slide plate (slide member) 2 slidably moves on the side surface of the housing 1. A rib 5 is provided at a bottom surface and a surface opposing the bottom surface of the housing 1, and holds down the slide plate 2 so as not to lift up. In FIG. 1, the rib provided at the surface opposing the bottom surface is not illustrated. A guide groove 6 is provided on an inner side of the side surface of the housing 1. Two projections 13 (FIGS. 3A-3B) are provided in a projecting manner at the side surface of the housing 1. The space between the two projections 13 is the guide groove 6. The projections 13 may be integrally molded to the housing 1 or may be fixed to the housing 1 afterwards. The window 3 displays the presence of ink in the ink cartridge. A projecting bulge may be formed at the housing 1 in place of the rib 5 or a plate-shaped material maybe stuck to the housing 1 to prevent the slide plate 2 from lifting up from the side surface.

Further, the housing 1 is formed into a box-shape by plastic and the like, and is configured to be removable with respect to each other by a fastening member such as a screw. That is, an ink bag 8 is fixed at the bottom surface of the housing 1.

The slide plate 2 is a plate made of plastic or metal, and is provided with a guide hole 7 slanted with respect to the sliding direction. The guide hole 7 and the guide groove 6 have a width to which a pin 11 of a plate 10 fixed to the ink bag 8, to be hereinafter described, can be fitted.

Figure 2:
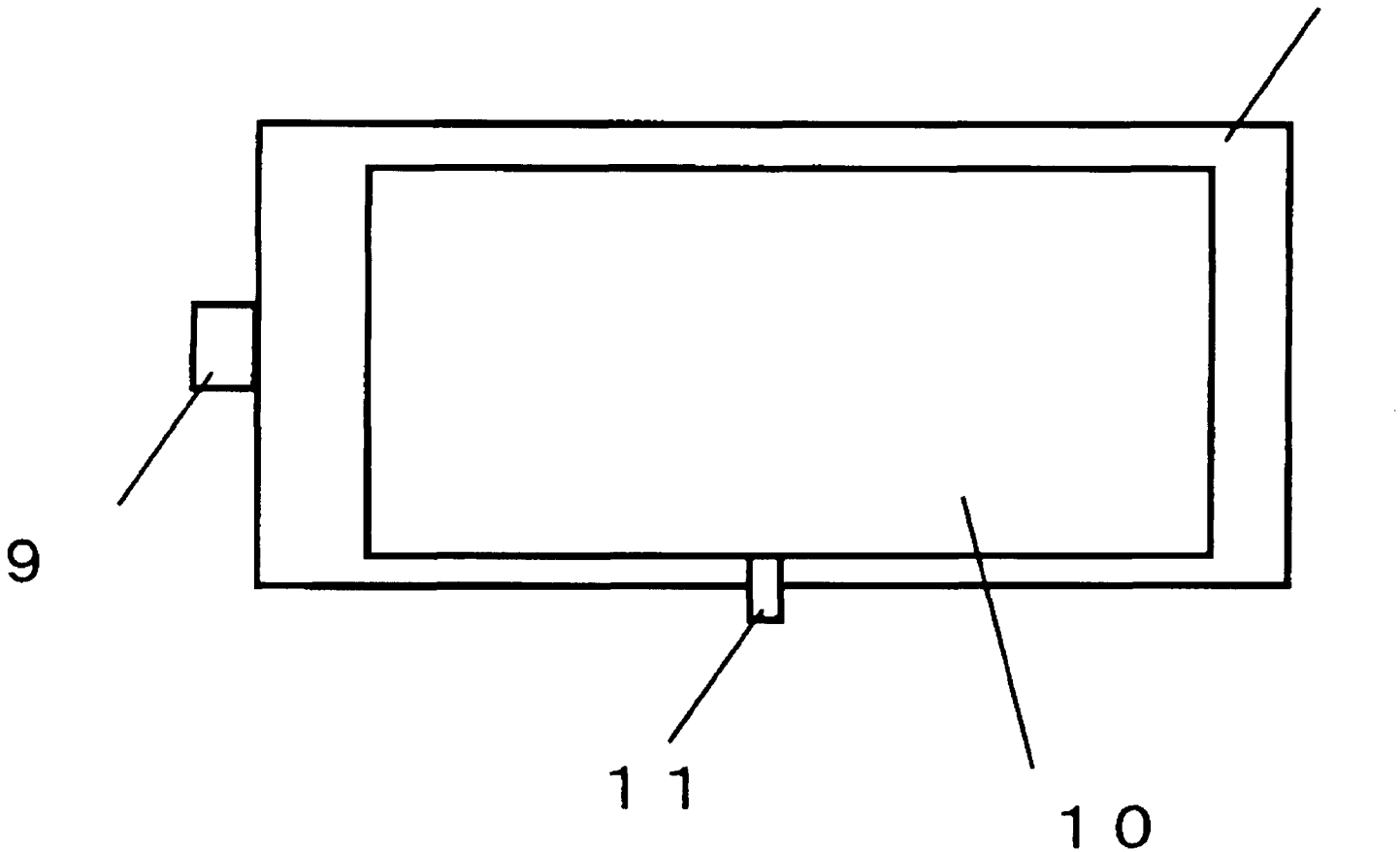
FIG. 2 is a schematic view of an ink bag.

FIG. 2 is a schematic view of the ink bag. The ink bag 8 is a flexible bag which has ink sealed in an inside thereof and the thickness of which changes according to the ink amount. The plate 10 including the pin 11 that projects to the outer side is fixed to the ink bag 8.

The ink bag 8 is configured by overlapping two aluminum laminate films, in which an aluminum foil is sandwiched by two films to enhance the gas barrier property, and joining the periphery by heat welding, or the like. For example, the outer side of the film is made of nylon film and the inner side of the film is made of polyethylene film. A spout 9 for discharging the interiorly sealed ink to the outside is joined to one end of the ink bag 8 by heat welding and the like. The spout 9 is formed into a pipe-shape by plastic, and the like. Further, one part of the spout 9 is exposed to the exterior of the housing 1 from the ink take-out port 4.

The plate 10 is formed into a flat plate shape by plastic, and the like, and is fixed to a substantially intermediate position on the front surface side of the ink bag 8 by adhesive, or the like. In addition, the above-mentioned pin 11 is integrally formed with the plate 10, and has such a length that the tip reaches the vicinity of the side surface of the housing 1.

Figure 3A:
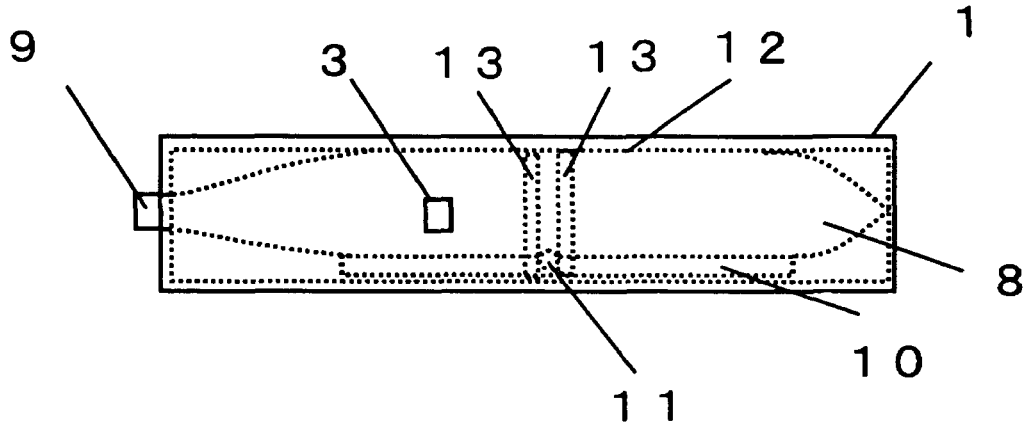
FIG. 3A is a view illustrating a state in which the ink is in the ink bag and FIG. 3B is a view illustrating a state in which the ink is not in the ink bag.
Figure 3B:
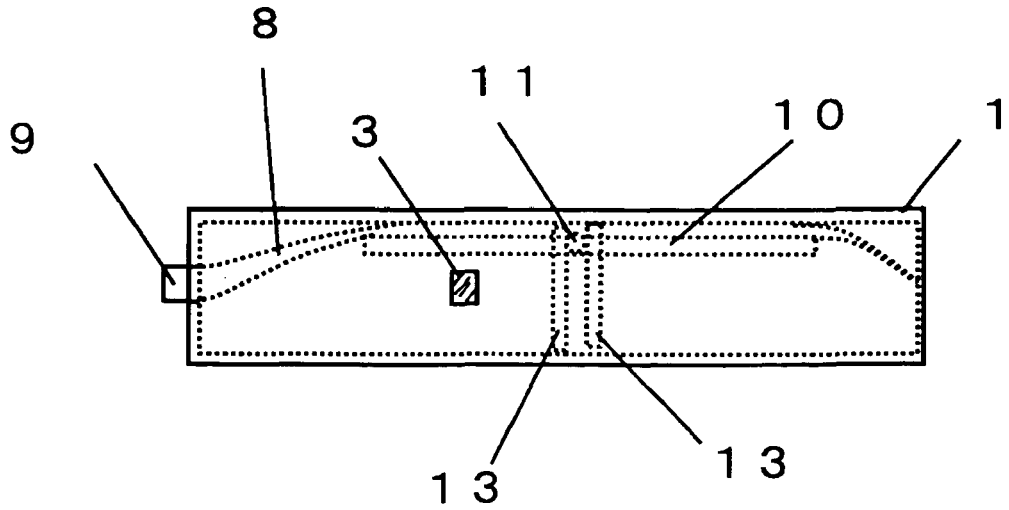

FIG. 3A is a view illustrating a state in which the ink is in the ink bag. FIG. 3B is a view illustrating a state in which the ink is not in the ink bag. The back surface 12 of the ink bag 8 is fixed to the bottom surface of the housing 1 by adhesive, or the like. In this case, the pin 11 is fitted between the pair of guide projections 13. As illustrated in FIG. 3A, the plate 10 is near the surface opposing the bottom surface of the housing 1 when the ink is sufficiently in the ink bag 8.

The window 3 is arranged at a position slightly shifted towards the spout 9 from a substantially central part of the side surface of the housing 1. The pin 11 is desirably near the middle in the length direction of the ink bag 8 to cooperatively operate the plate 10 and the pin 11 in accordance with the expansion and the contraction of the ink bag 8. When the pin 11 is at a displaced position, the pin 11 over- or under-moves if the plate 10 is slanted. The reflecting plate displayed in the window 3 also changes by the movement of the slide plate 2, and thus the window 3 is arranged at a position corresponding to the movement amount of the slide plate 2, that is, at a position slightly shifted towards the spout 9 from the substantially central part of the side surface of the housing 1.

As illustrated in FIG. 3B, the ink bag 8 contracts if the ink is not in the ink bag 8. The plate 10 moves towards the bottom surface of the housing 1. The pin 11 moves towards the bottom surface of the housing 1 between the guide projections projection 13. The movement direction of the pin 11 is regulated to be perpendicular to the thickness direction of the ink bag 8 by the guide projections 13, that is, the guide groove 6. Further, the display of the window 3 when the bag 8 contains ink is different from the display when the bag 8 does not contain ink; (i.e., when the ink is consumed.

Figure 4A:
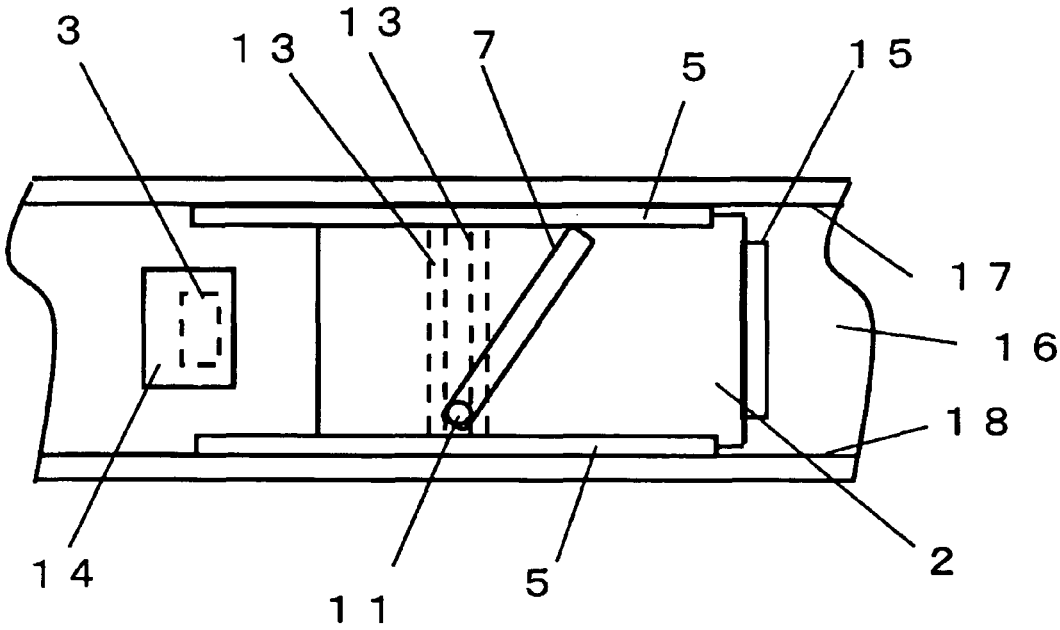
FIG. 4A is a view showing a position of a slide plate when the ink is in the ink bag and FIG. 4B is a view showing a position of the slide plate when the ink is not in the ink bag.
Figure 4B:
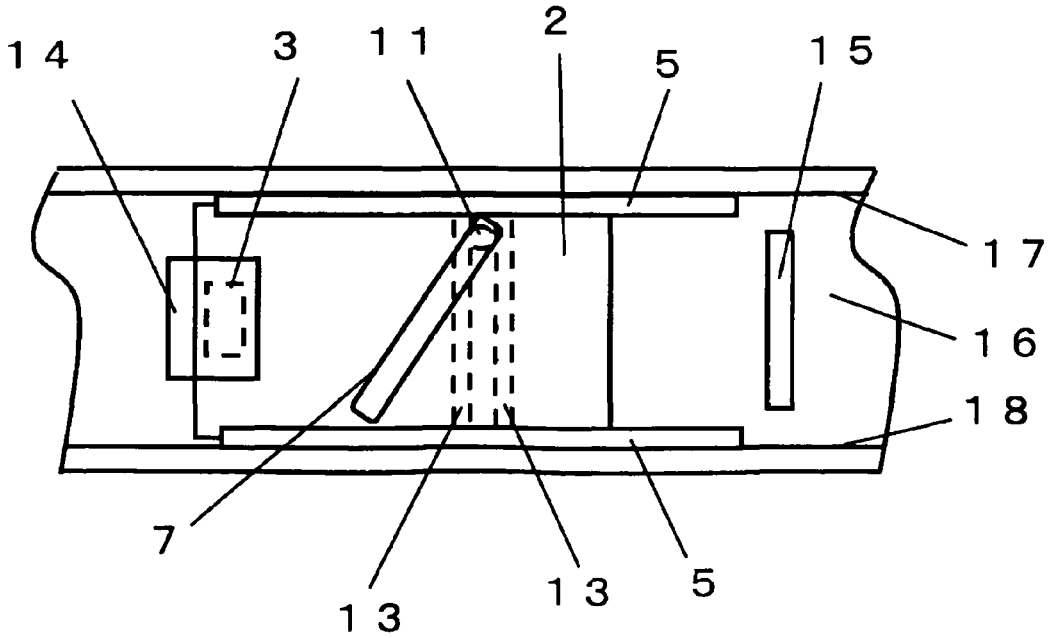

The operation of the periphery of the slide plate 2 is now described. FIG. 4A is a view showing a position of the slide plate 2 when the ink is in the ink bag. FIG. 4B is a view showing a position of the slide plate 2 when the ink is not in the ink bag.

The side surface 16 of the housing 1 is sandwiched by the bottom surface 17 of the housing 1 and the surface 18 opposing the bottom surface 17. The rib 5 is arranged at the bottom surface 17 and the surface 18 opposing the bottom surface 17. The rib 5 regulates the slide plate 2 so as not to separate from the side surface 16. A stopper 15 is a rib-shaped projection provided in a projecting manner at the side surface 16 to limit the movement of the slide plate 2. A first reflecting plate 14 is provided on the side surface 16, and is provided to cover the window 3, to separate from the side surface 16 by equal to or larger distance than the thickness of the slide plate 2, and to open the direction of the slide plate 2.

The pin 11 is inserted into the guide hole 7 of the slide plate 2. The pin 11 is passed through the slide plate 2, and fitted in the guide groove 6 between the guide projections 13. The pin 11 linearly moves between the guide projections 13 according to the volume of the ink. The position where the guide hole 7 and the pin 11 contact changes by the movement of the pin 11. In other words, the slide plate 2 slidably moves on the side surface 16 between the stopper 15 and the first reflecting plate 14.

The movement amount of the slide plate 2 can be more extended by sliding the slide plate 2 in the longitudinal direction of the side surface 16, that is, in the direction perpendicular to the thickness direction of the ink bag 8 than by turning or sliding the slide plate 2 in the horizontal direction. Even if a detector, to be hereinafter described, is slightly deviated in the bottom surface 17 direction, error detection can be prevented by increasing the area of the opening of the window 3 in the bottom surface direction. The degree of freedom in the arrangement of parts thus can be easily enhanced in such manner.

FIG. 4A shows a case where the ink is filled up, where the pin 11 is on the surface 18 side opposing the bottom surface, and the slide plate 2 is contacting the stopper 15. The first reflecting plate 14 is displayed from the window 3.

FIG. 4B shows a case where the ink is consumed, where the pin 11 is on the bottom surface 17 side, and the slide plate 2 is in contact with the first reflecting plate 14. The slide plate 2 is displayed from the window 3.

The slide plate 2 includes a reflecting plate (second reflecting plate) having a second reflectivity different from the reflectivity of the first reflecting plate 14. The reflecting plates each having a different reflectivity thus can be displayed from the window 3 when ink remains in the bag 8 and when the ink is consumed, respectively.

The slide plate 2 is applied with paint or stuck with a reflecting sheet for the reflecting plate of the second reflectivity.

Figure 5:
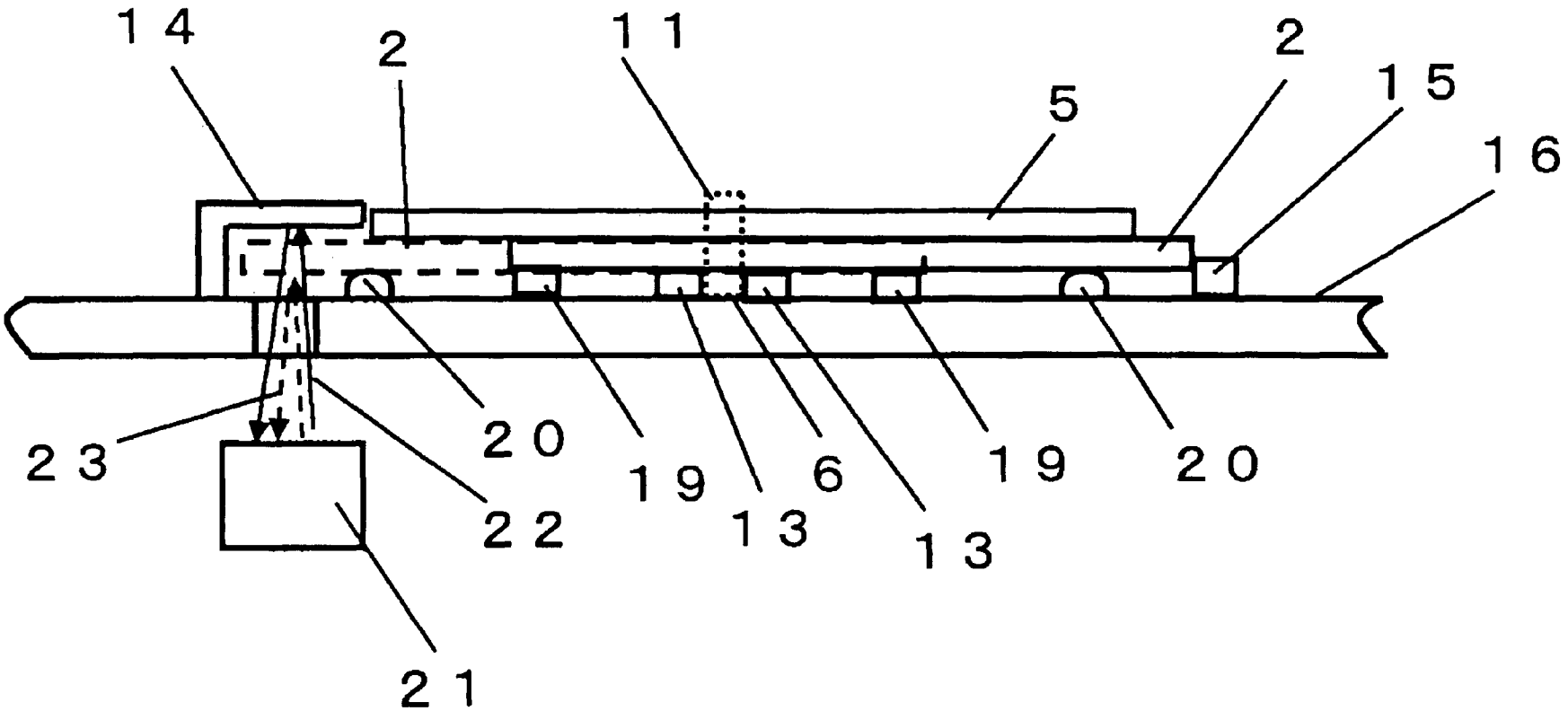
FIG. 5 is a view illustrating a first mode of the periphery of the slide plate.

FIG. 5 is a view illustrating a first mode of the periphery of the slide plate. The slide plate 2 is sandwiched by the rib 5, the projections 13, a first supporting rib 19, and a second supporting rib 20 provided in a projecting manner on the side surface 16. Further, the slide plate 2 is slidable between the stopper 15 and the first reflecting plate 14 according to the movement of the pin 11 along the guide groove 6. The first supporting rib 19 and the second supporting rib 20 may be discontinuous projections, may be integrally molded or may be fixed afterwards.

The first supporting rib 19 is arranged on the outer side of the guide projection 13, and the second supporting rib 20 is arranged on the outer side of the first supporting rib 19. As the first supporting rib 19 is arranged and the second supporting rib 20 is arranged on the outer side thereof, the friction resistance in time of the slidable movement can be reduced more than when slidably moving on the side surface 16. The movement becomes smoother, and an error operation due to friction resistance can be prevented. Further, the first supporting rib 19 is a rib that is always in contact with the slide plate 2 moves even if the slide plate 2 moves, and the second supporting rib 20 is a rib that may contact or may not contact with the slide plate 2 according to the movement of the slide plate 2. The first supporting rib 19 and the second supporting rib 20 may have the same shape, but preferably have different shapes. For example, a taper on the contacting surface side with the slide plate 2 is larger in the second supporting rib 20. The end of the slide plate 2 is thus prevented from hitting the supporting rib 20 and being supported thereby when the slide plate 2 moves. Problems do not arise even if the area that is always contacting has a small taper.

A detector 21 is a detector that irradiates light and detects the reflected light reflected by and returned from the reflecting plate. Although not illustrated, the detector 21 detects the reflected light, detects at least whether or not the reflected light is present, and outputs the result. The detector preferably detects the light quantity of the reflected light and outputs a value corresponding to the light quantity.

When the slide plate 2 is at the position of the solid line, that is, when the ink is left (i.e., when the bag 8 contains ink), the optical path of a first detection light 22, which is indicated with a solid line, that hits the first reflecting plate 14 and is returned from the first reflecting plate 14 is taken. When the slide plate 2 is at the position of the dotted line, that is, when the ink is consumed (i.e., when the bag does not contain ink), the optical path of a second detection light 23, which is indicated with a dotted line, that hits the slide plate 2 and is returned from the slide plate 2 is taken.

The reflectivity of each of the first reflecting plate 14 and the slide plate 2 differs, and hence the output of the detector 21 is also an output corresponding to the respective reflectivity. The presence of ink can be detected by such difference in reflectivity.

Figure 6:
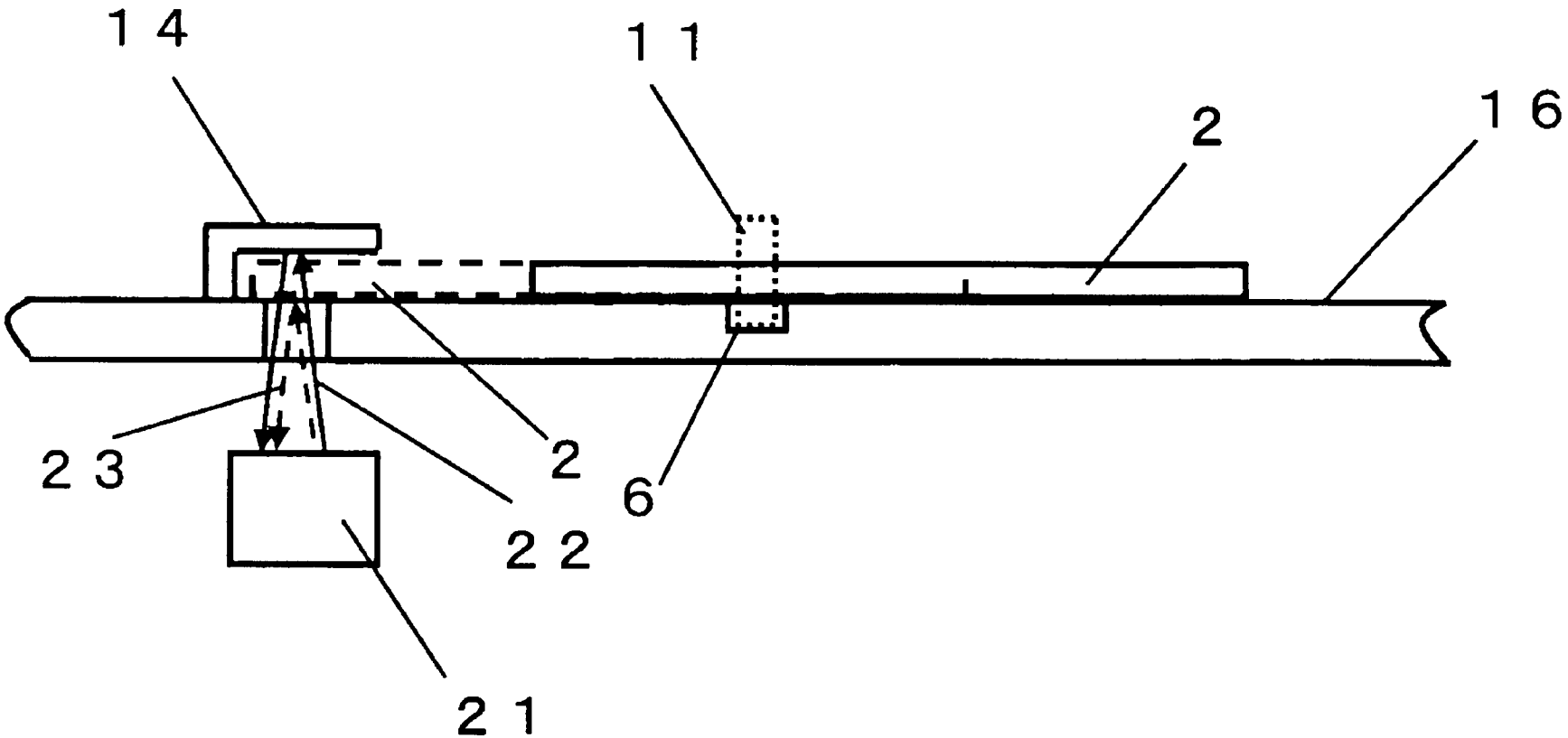
FIG. 6 is a view illustrating a second mode of the periphery of the slide plate.

FIG. 6 is a view illustrating a second mode of the periphery of the slide plate. The side surface 16 and the slide plate 2 are brought into contact with each other. The guide groove 6 is configured by forming the side surface 16 to a recessed-shape. The pin 11 that passed through the slide plate 2 is then fitted thereto, and moves along the linear guide groove 6. Downsizing thereof can thus be achieved since ribs are not provided.

Figure 7:
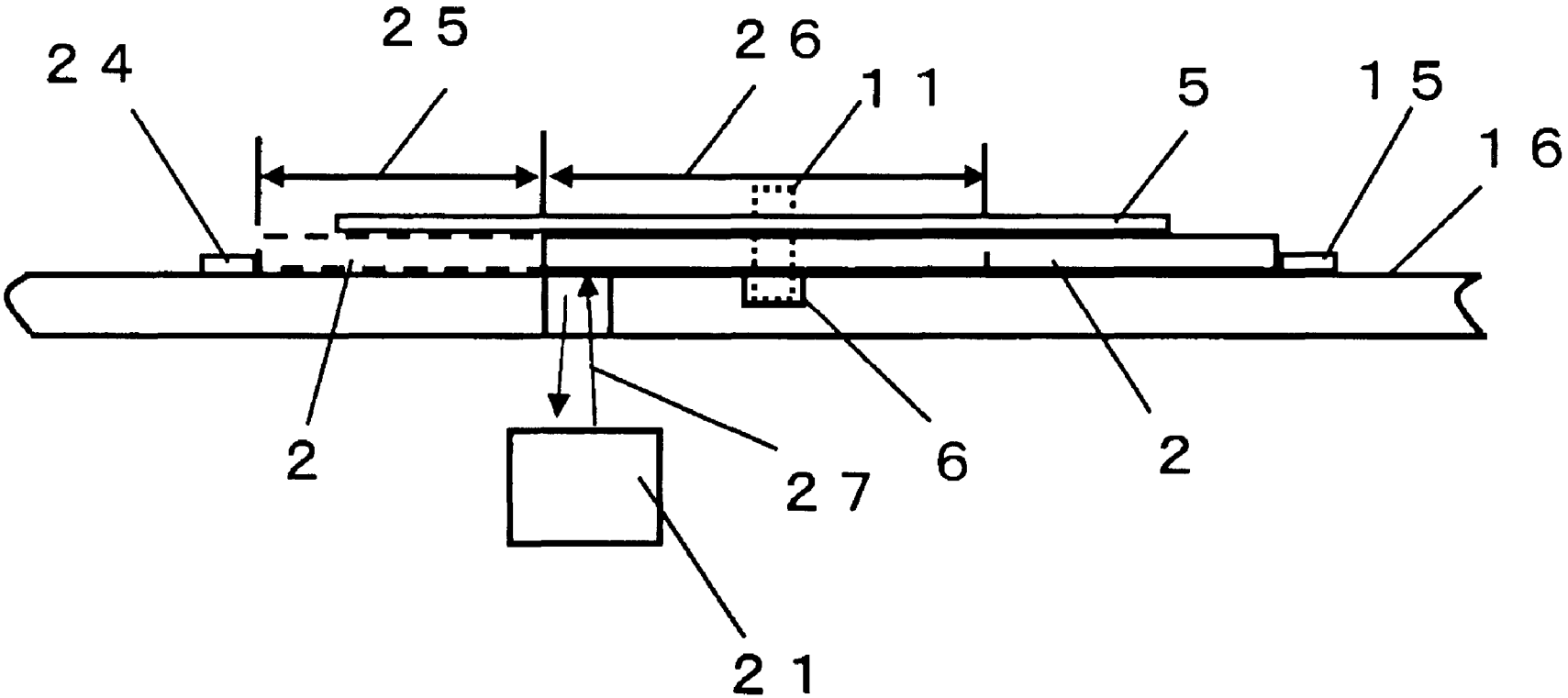
FIG. 7 is a view illustrating a third mode of the periphery of the slide plate.

FIG. 7 is a view illustrating a third mode of the periphery of the slide plate. The first reflecting plate 14 is not arranged. Instead, a stop rib 24 for regulating the movement of the slide plate 2 is provided to fix the movement range of the slide plate 2. Further, the slide plate 2 is divided into at least two regions. In other words, the slide plate 2 is divided into a first region 25 of the slide plate 2 and a second region 26 of the slide plate 2 so that the respective reflectivity are differed. For example, the slide plate 2 is painted white and black. White has higher reflectivity than that of black. Alternatively, a sheet having a known reflectivity is stuck. The detector 21 irradiates light and detects the light hitting and reflected by the slide plate 2. The optical path in this case is a detection light 27 shown with an arrow in FIG. 7. According to such structure, further downsizing thereof can be achieved because the first reflecting plate 14 is unnecessary.

The slide plate 2 needs to provide regions with at least two types of reflectivity. However, the position of the slide plate 2 corresponding to the ink capacity differs, and hence the ink capacity can be more finely detected by changing the reflectivity according to the respective position. The detector 21 may output to a control means of a printer (not shown), and hence the control means can perform various controls according to such output. The change in the ink volume can be segmentalized and detected by arranging a reflecting plate in which the reflectivity is changed continuously to the slide plate 2 and arranging an analog-to-digital (AD) converter at an input portion of the control means.

Figure 8A:
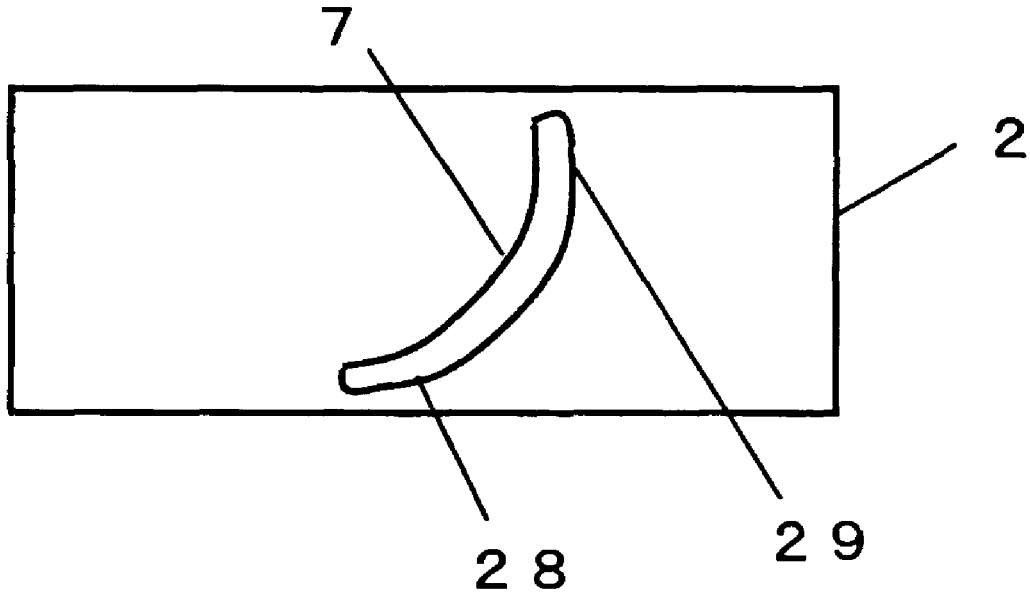
FIGS. 8A and 8B are views illustrating another mode of a guide hole of the slide plate.
Figure 8B:
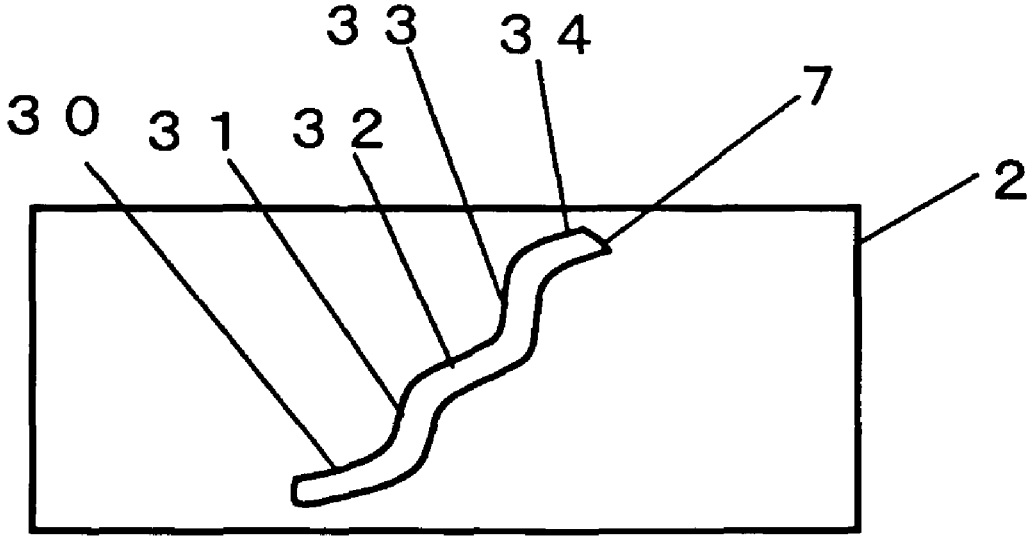

FIG. 8A and FIG. 8B are views showing another mode of the guide hole of the slide plate. The guide hole 7 has a steep slope in the vicinity of a location 28 where the ink amount of the ink cartridge is large, and hence the movement amount of the slide plate 2 becomes large with respect to the consuming rate of the ink. The slope of the guide hole 7 is small at a state vicinity 29 where the ink amount is small, and hence the movement amount of the slide plate 2 becomes small. FIG. 8B shows a more complex guide hole. The guide hole 7 includes five regions. At a first region 30, a third region 32, and a fifth region 34, the guide hole 7 has a steep slope, and thus the movement amount of the slide plate 2 becomes large with respect to the consuming rate of the ink. At a second region 31 and a fourth region 33, the guide hole 7 has a small slope, and thus the movement amount of the slide plate 2 becomes small with respect to the consuming rate of the ink. The consuming rate of the ink and the movement amount of the slide plate in time of a predetermined ink residual amount can be controlled by the shape of the guide hole 7. When desiring to finely display or to roughly display in time of the desired ink residual amount, this can be achieved by changing the shape of the guide hole 7.

Figure 9:
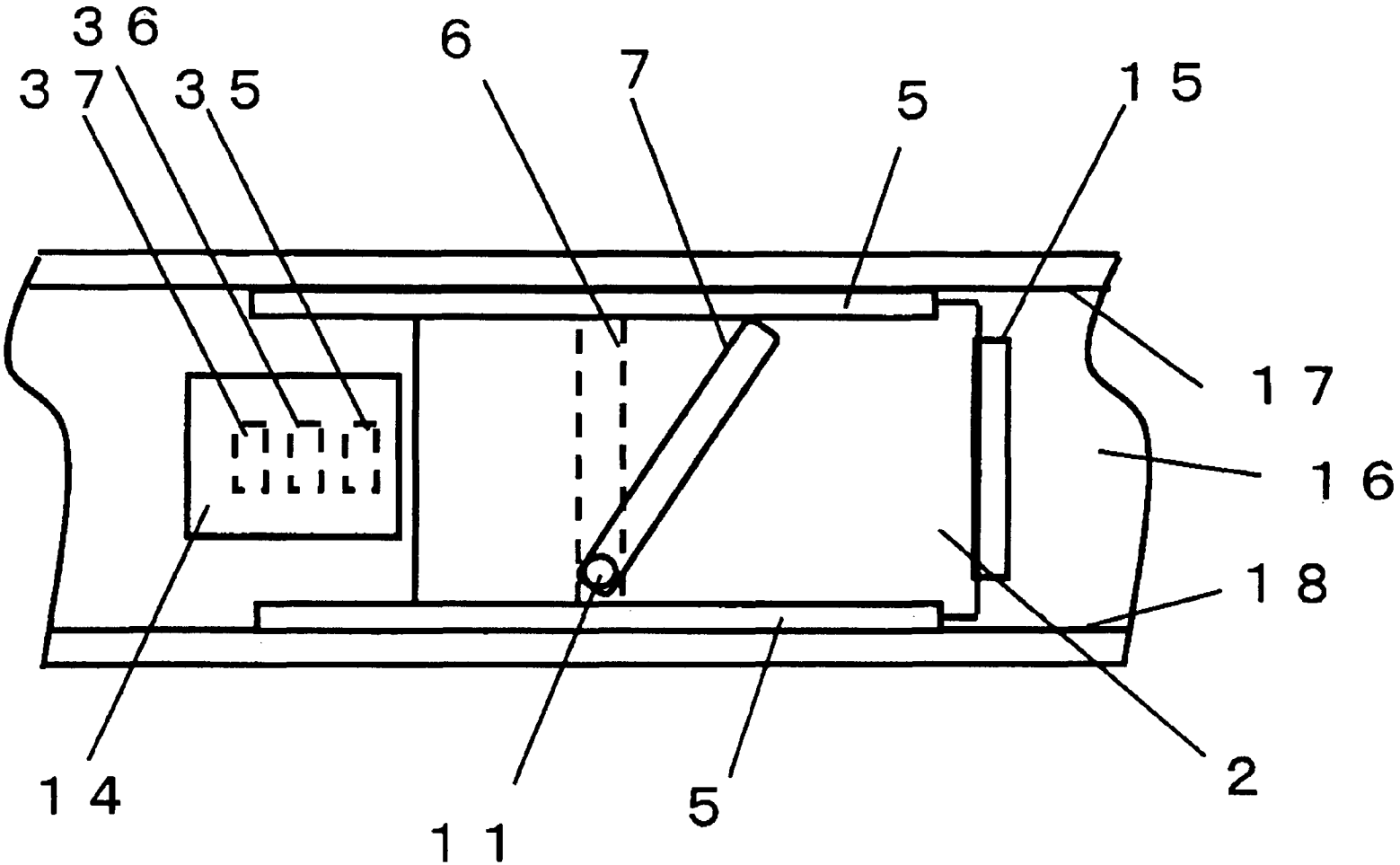
FIG. 9 is a view illustrating a fourth mode of the periphery of the slide plate.
Figure 10:
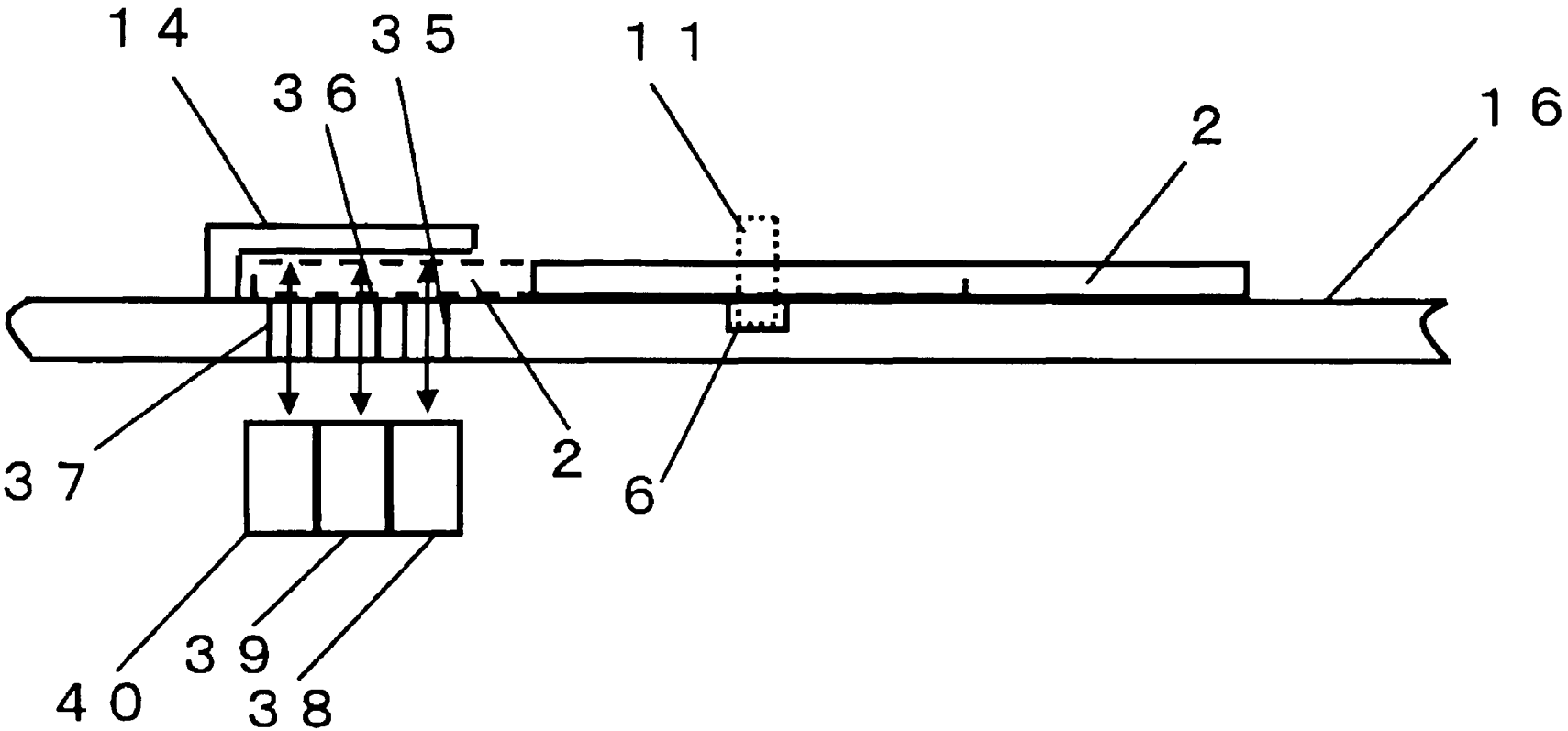
FIG. 10 is a view illustrating an example of an arrangement of a detector of the fourth mode.

FIG. 9 is a view illustrating a fourth mode of the periphery of the slide plate. FIG. 10 is a view showing an example of an arrangement of the detector of the fourth mode. In the fourth mode, the window 3 and the detector 21 in the second mode of the periphery of the slide plate described in FIG. 6 are replaced with plural windows and corresponding detectors. More specifically, a first detector 38, a second detector 39, and a third detector 40 are arranged in correspondence to a first window 35, a second window 36, and a third window 37.

The ink residual amount can be detected in plural stages, or three stages in the exemplary embodiment herein. The ink residual amount can be detected more precisely and notified to the user by detection of the ink residual amount in plural stages. The user recognizes the ink residual amount by looking at the detection result.

The pin 11 operates along the guide groove 6 when the volume of the ink changes. The pin 11 is brought into contact with the guide hole 7 of the slide plate 2, and slidably moves: The guide plate 2 is regulated by the rib 5 and slides along the side surface 16. The guide plate 2 covers the first window 35, the second window 36, and the third window 37 depending on the ink capacity. The ink residual amount can be detected by the covered window.

The angle between the expanding and contracting direction of the ink bag 8, that is, the movement direction of the plate 10 and the movement direction of the slide plate 2 is approximately 90 degrees. The slide plate 2 needs to be slid on the side surface 16 to arrange the window group at the side surface 16. In the case of a mechanism of moving the slide plate 2 in the same direction as the movement direction of the plate 10, a space that enables the slide plate 2 to move in the direction of the bottom surface 17 or the surface 18 opposing the bottom surface 17 needs to be provided, and hence the size becomes large with respect to the relevant direction. For downsizing, the slide plate 2 needs to be moved in a direction different with respect to the movement direction of the slide plate 2, such as in a direction different by 90 degrees.

According to the ink cartridge of the present invention described above, a regular movement is performed every time to display the ink residual amount so that error detection of the ink residual amount can be prevented.

In addition, the present invention can be used in an ink cartridge of an ink jet printer, and the like.

What is claimed is:

1. An ink cartridge comprising:

a flexible ink bag which has ink sealed in advance in an inside thereof and which undergoes movement and is changed in thickness in accordance with a change in the amount of ink contained in the ink bag;

a housing accommodating the ink bag, the housing having a side surface and a guide groove formed in the side surface;

a plate connected to a surface of the ink bag for undergoing movement with the ink bag, the plate having a pin protruding toward the side surface of the housing, the guide groove being formed in a size allowing insertion of the pin and regulating movement of the pin during movement of the plate;

a window provided at the side surface of the housing;

a first reflecting plate having a first reflectivity and configured to be displayed by the window in a state in which the ink bag contains ink; and a slide member mounted to undergo sliding movement on the side surface of the housing and arranged slanted with respect to a sliding direction, the slide member having a guide hole into which the pin of the plate is inserted and a second reflecting plate having a second reflectivity different from the first reflectivity of the first reflecting plate, the second reflecting plate being configured to be displayed by the window in a state in which the ink bag does not contain ink;

wherein when the plate undergoes movement with the ink bag in accordance with a change in the amount of ink contained in the ink bag, the pin of the plate moves along the guide groove of the housing and along the guide hole in association with the plate movement, the slide member slidably moves on the side surface of the housing by the movement of the pin along the guide hole, and, in accordance with the sliding movement of the slide member, the window displays the first reflecting plate when the ink bag contains ink and displays the second reflecting plate when the ink bag does not contain ink.

2. An ink cartridge according to claim 1; wherein the first reflecting plate is disposed opposite the window at a position spaced apart to an inner side by a predetermined distance from the side surface of the housing, the slide member being positioned between the window and the first reflecting plate by the movement of the slide member when the ink is consumed so that the first reflecting plate is displayed from the window.

3. An ink cartridge according to claim 2; wherein a pair of projections are provided on the bottom surface and a surface opposing the bottom surface, respectively, of the housing, the movement of the slide member being regulated by the projections so as not to separate from the side surface of the housing.

4. An ink cartridge according to claim 2; wherein the first reflecting plate is white and the second reflecting plate is black.

5. An ink cartridge according to claim 1; wherein the guide groove is formed between a pair of projections arranged on the side surface of the housing.

6. An ink cartridge according to claim 5; wherein the projections reduce a friction resistance between the slide member and the side surface of the housing when the slide member slidably moves on the side surface of the housing.

7. An ink cartridge according to claim 1; wherein the guide groove comprises a row of recess portions provided at the side surface of the housing.

8. An ink cartridge according to claim 1; wherein the guide hole has a curved long hole shape so that a consuming rate of the ink in the ink bag and a rate of a movement amount of the slide member differ.

9. An ink cartridge according to claim 1; wherein the window comprises a plurality of windows that are selectively covered during sliding movement of the slide member; and the number of the windows to be covered by the slide member changes in a step-wise manner during sliding movement of the slide member in accordance with the ink amount contained in the ink bag.

10. An ink cartridge according to claim 1; wherein an angle formed between a movement direction of the pin and a movement direction of the plate is about 90 degrees.

11. An ink cartridge according to claim 1; wherein the guide hole has a long hole shape.

12. An ink cartridge according to claim 1; wherein the guide groove has a linear shape; and wherein the pin of the plate linearly moves along the guide groove when the plate undergoes movement with the ink bag in accordance with a change in the amount of ink contained in the ink bag.

13. A method of displaying a residual amount of ink in an ink cartridge, the method comprising:

providing an ink cartridge comprising a flexible ink bag which has ink sealed in advance in an inside thereof and which undergoes movement and is changed in thickness in accordance with a change in the amount of ink contained in the ink bag; a housing accommodating the ink bag, the housing having a side surface and a guide groove formed in the side surface; a plate connected to a surface of the ink bag for undergoing movement with the ink bag, the plate having a pin protruding toward the side surface of the housing, the guide groove being formed in a size allowing insertion of the pin and regulating movement of the pin during movement of the plate; a window provided at the side surface of the housing; a first reflecting plate having a first reflectivity and configured to be displayed by the window in a state in which the ink bag contains ink; and a slide member mounted to undergo sliding movement on the side surface of the housing and arranged slanted with respect to a sliding direction, the slide member having a guide hole into which the pin of the plate is inserted and a second reflecting plate having a second reflectivity different from the first reflectivity of the first reflecting plate, the second reflecting plate being configured to be displayed by the window in a state in which the ink bag does not contain ink;

causing the pin of the plate to move along the guide groove of the housing in accordance with a change in the amount of ink contained in the ink bag;

slidably moving the slide member on the side surface of the housing in accordance with movement of the pin;

displaying the first reflecting plate from the window in accordance with a position of the slide member on the side surface of the housing when the ink bag contains ink; and displaying the second reflecting plate from the window in accordance with a position of the slide member on the side surface of the housing when the ink bag does not contain ink.

14. A residual amount display method according to claim 13; wherein the slide member moves in association with the consumption of the ink bag so that a consumption rate of the ink and a rate of a movement amount of the slide member differ.

15. An ink cartridge comprising:

a flexible ink bag for containing ink and which changes in thickness in accordance with a change in the amount of ink contained in the ink bag;

a housing for accommodating the ink bag, the housing having a side surface and a guide groove and a window portion formed in the side surface;

a plate mounted on the ink bag for movement therewith during a change in thickness of the ink bag, the plate having a pin that undergoes guided movement in the guide groove during movement of the plate;

a reflecting plate having a first reflectivity and configured to be displayed by the window in a state in which the ink bag contains ink; and a slide member having a reflecting portion with a second reflectivity different from the first reflectivity, the slide member being disposed in engagement with the plate pin for undergoing sliding movement relative to the housing during movement of plate pin so that in a first position of the slide member relative to the housing, the slide member does not cover. the window portion of the housing and the reflecting plate is displayed from the window portion of the housing corresponding to a state in which the ink bag contains ink, and so that in a second position of the slide member relative to the housing, the slide member covers the window portion of the housing and the reflecting portion of the slide member is displayed from the window portion of the housing corresponding to a state in which the ink bag does not contain ink.

16. An ink cartridge according to claim 15; further comprising a pair of projections arranged on the side surface of the housing, the projections being separated by a space forming the guide groove.

17. An ink cartridge according to claim 15; wherein the ink bag has a spout for discharging the ink contained, in the ink bag; and wherein the window portion is disposed at a position shifted towards the spout from a substantially central part of the side surface of the housing.

18. An ink cartridge according to claim 15; further comprising means for limiting sliding movement of the slide member relative to the housing, and means for preventing separation of the slide member from the housing during sliding movement of the slide member.

* * * * *